US009472858B2

(12) United States Patent
Yeh et al.

(10) Patent No.: US 9,472,858 B2
(45) Date of Patent: Oct. 18, 2016

(54) CONNECTOR FOR A SWITCH MODULE

(71) Applicant: ARCADYAN TECHNOLOGY CORPORATION, Hsinchu (TW)

(72) Inventors: Chun-Hung Yeh, Hsinchu (TW); Hao-Fei Lin, Hsinchu (TW)

(73) Assignee: Arcadyan Technology Corporation, Hsinchu (TW)

( * ) Notice: Subject to any disclaimer, the term of this patent is extended or adjusted under 35 U.S.C. 154(b) by 270 days.

(21) Appl. No.: 14/287,579

(22) Filed: May 27, 2014

(65) Prior Publication Data

US 2014/0354511 A1 Dec. 4, 2014

(30) Foreign Application Priority Data

May 29, 2013 (TW) ..... 102119016 A

(51) Int. Cl.

| | |
|---|---|
| ***H01Q 21/00*** | (2006.01) |
| ***H01R 29/00*** | (2006.01) |
| ***H01R 24/46*** | (2011.01) |
| ***H01R 33/96*** | (2006.01) |

(52) U.S. Cl.

CPC ..... *H01Q 21/0006* (2013.01); *H01R 24/46* (2013.01); *H01R 29/00* (2013.01); *H01R 33/96* (2013.01)

(58) Field of Classification Search

CPC .. H01Q 21/0006; H01R 33/96; H01R 24/46; H01R 29/00

See application file for complete search history.

(56) References Cited

U.S. PATENT DOCUMENTS 5,453,019 A * 9/1995 Garver ..... H01R 13/7033 439/188
5,944,546 A * 8/1999 Miyake ..... H01R 24/46 200/51.03

FOREIGN PATENT DOCUMENTS

CN 2351882 Y 12/1999
CN 101409571 A 4/2009

OTHER PUBLICATIONS

Office Action received in Chinese Patent Application No. 201310239593.2, dated Dec. 2, 2015.

* cited by examiner

*Primary Examiner* — Hoang V Nguyen
(74) *Attorney, Agent, or Firm* — Haynes and Boone, LLP

(57) ABSTRACT

A connector is provided. The connector includes a first cavity, including a housing conductor having a receiving space formed at an inner side thereof, and connected to a ground; and a signal conductor disposed in the receiving space; a second cavity fixed to a side of the first cavity; and a flexible conductor having a connecting end, a propping end and an arc structure, wherein the connecting end is electrically connected to a control circuit, the propping end props the housing conductor, the arc structure is disposed in the second cavity and has a specific shape and a flexibility, and when the signal conductor is connected to a joint of a first antenna, the specific shape is deformed to cause the propping end to be disconnected from the housing conductor, thereby causing the control circuit to enable the first antenna.

13 Claims, 8 Drawing Sheets

CONNECTOR FOR A SWITCH MODULE

CROSS-REFERENCE TO RELATED APPLICATION AND CLAIM OF PRIORITY

The application claims the benefit of Taiwan Patent Application No. 102119016, filed on May 29, 2013, in the Taiwan Intellectual Property Office, the disclosures of which are incorporated herein in their entirety by reference.

FIELD OF THE INVENTION

The present invention relates to a switch module, and more particularly to a switch module for a connector.

BACKGROUND OF THE INVENTION

Many wireless communication devices are equipped with a built-in antenna disposed near the main circuit of the wireless communication device. The built-in antenna is limited to the restricted disposition space and the circuit interference so that the effect of receiving and sending signals is poor. Therefore, some wireless communication devices reserve a connecting terminal for the external antenna so that the above issues can be improved by the external antenna.

When the external antenna is not connected to the wireless communication device, the built-in antenna is connected to the radio frequency circuit in the wireless communication device. However, when the external antenna is connected to the above-mentioned reserved connecting terminal, a mechanism is required to cut off the signal connection with the built-in antenna so as to be converted to the signal connection with the external antenna. Hence, a connector having the signal switch function is required.

However, the conventional connectors having the signal switch function need to be implemented by extremely complicated mechanisms so that the manufacturing processes thereof are complex and the production costs thereof are enhanced.

In order to overcome the drawbacks in the prior art, a connector for a switch module is provided. The particular design in the present invention not only solves the problems described above, but also is easy to be implemented. Thus, the present invention has the utility for the industry.

SUMMARY OF THE INVENTION

In accordance with an aspect of the present invention, a connector is provided, which uses a simple structure and a control circuit to quickly and easily switch the signals of different antennas.

In accordance with another aspect of the present invention, a connector is provided. The connector includes a first cavity, including a housing conductor having a receiving space formed at an inner side thereof, and connected to a ground; and a signal conductor disposed in the receiving space; a second cavity fixed to a side of the first cavity; and a flexible conductor having a connecting end, a propping end and an arc structure, wherein the connecting end is electrically connected to a control circuit, the propping end props the housing conductor, the arc structure is disposed in the second cavity and has a specific shape and a flexibility, and when the signal conductor is connected to a joint of a first antenna, the specific shape is deformed to cause the propping end to be disconnected from the housing conductor, thereby causing the control circuit to enable the first antenna.

In accordance with a further aspect of the present invention, a switch module for a wireless transmit receive unit (WTRU) having a radio frequency circuit, a built-in antenna and a ground terminal is provided. The switch module includes a switch device having a first antenna terminal, a second antenna terminal, a first terminal, a second terminal, a third terminal and a fourth terminal, wherein the first antenna terminal is configured to connect the built-in antenna, the first terminal is connected to the radio frequency circuit, the second antenna terminal is configured to connect an external antenna, and the fourth terminal is connected to the ground terminal; and a control circuit electrically connected to the switch device, causing the first terminal to be connected to one of the first antenna terminal and the second terminal when the third terminal is connected to the fourth terminal, and causing the first terminal to be connected to the other of the first antenna terminal and the second terminal when the third terminal is disconnected from the fourth terminal.

In accordance with further another aspect of the present invention, a connector for a switch module having a first antenna terminal, a first terminal, a second terminal and a third terminal is provided. The connector includes a connector body; a second antenna terminal disposed in the connector body; a fourth terminal disposed in the connector body; and a flexible conductor having a first conductor terminal electrically connected to the third terminal, and a second conductor terminal, wherein when the second conductor terminal is connected to the fourth terminal, the flexible conductor causes the first terminal to be connected to one of the first antenna terminal and the second terminal, and when the second conductor terminal is disconnected from the fourth terminal, the flexible conductor causes the first terminal to be connected to the other of the first antenna terminal and the second terminal.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Figure 1:
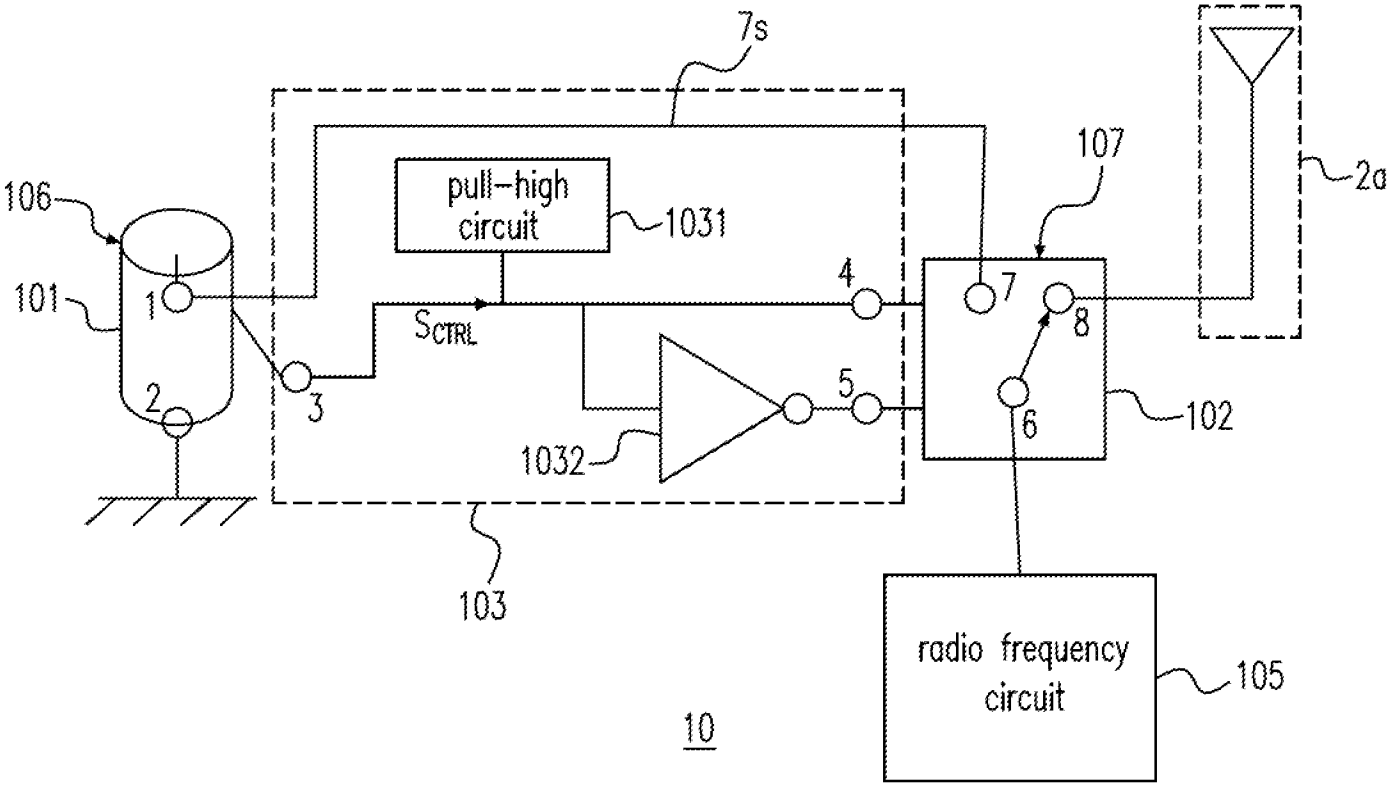
FIG. 1 shows a wireless transmit receive unit (WTRU) according to an embodiment of the present invention.

Please refer to FIG. 1, which shows a wireless transmit receive unit 10 according to an embodiment of the present invention. The wireless transmit receive device 10 includes a connector 101, a signal switch 102 and a control circuit 103. The wireless transmit receive device 10 further includes a built-in antenna 2*a* and a radio frequency circuit 105. Preferably, the connector 101 can be a mechanical switch 106 for being connected to an external antenna (not shown). Preferably, the signal switch 102 can be an electronic switch 107.

The connector 101 has contacts 1 and 2. The contact 1 is connected to the contact 7 of the signal switch 102 via the antenna signal cable 7*s*. Preferably, the antenna signal cable 7*s* is a coaxial cable. The contact 2 is grounded. When the external antenna is not coupled to the connector 101, the contact 2 is connected to the contact 3. The control circuit 103 has contacts 3, 4 and 5.

The control circuit 103 further includes a pull-high circuit 1031 and an inverter 1032. The pull-high circuit 1031 is electrically connected to the contact 4. The inverter 1032 is electrically connected between the pull-high circuit 1031 and the contact 5. As shown in FIG. 1, when the external antenna is not coupled to the connector 101, since the contact 2 is connected to the contact 3 and grounded, the contact 4 is at a relatively low potential and the contact 5 is at a relatively high potential. The control circuit 103 is connected to the signal switch 102 via the contacts 4 and 5. For example, the signal switch 102 can be a digital switch, and has contacts 6, 7 and 8 for switching. The contact 6 is connected to the radio frequency circuit 105, and the contact 8 is connected to the built-in antenna 2*a*.

As shown in FIG. 1, since the contact 4 is at a relatively low potential and the contact 5 is at a relatively high potential, the control signal SCTRL generated by the control circuit 103 causes the signal switch 102 to connect the contact 6 with the contact 8, thereby causing the built-in antenna 2*a* to be connected to the radio frequency circuit 105. Therefore, the built-in antenna 2*a* can operate to receive and send the radio frequency signal.

Figure 2:
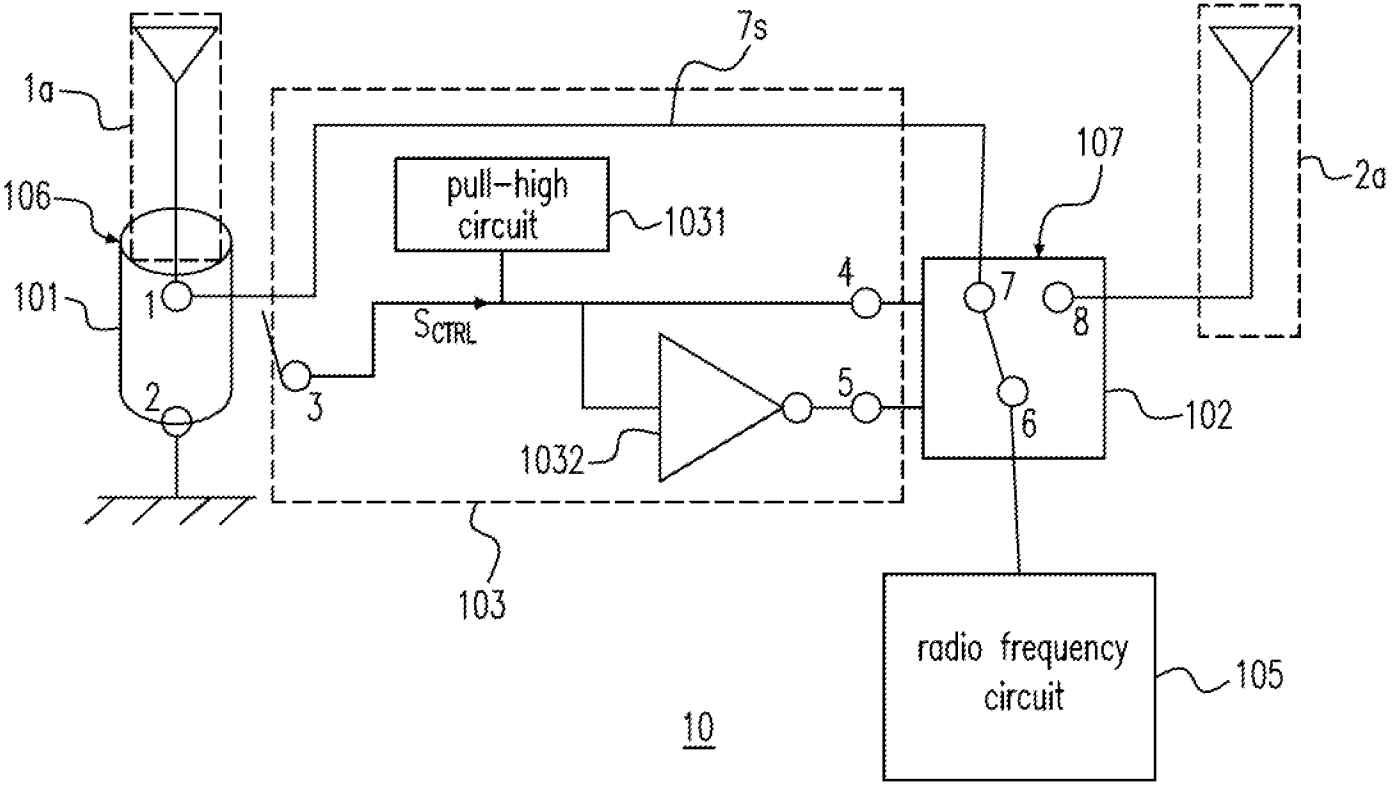
FIG. 2 shows the switching of a signal switch according to an embodiment of the present invention.

Please refer to FIG. 2, which shows the switching of a signal switch 102 according to an embodiment of the present invention. As shown in FIG. 2, when the connector 101 is coupled to an external antenna 1*a*, e.g. in an inserting way or in a screwing way, the contact 1 is electrically connected to the external antenna 1*a*, and the contact 2 is disconnected from the contact 3. The structure of the connector 101 and the switching way will be described hereinafter. In this state, since the contact 3 is disconnected from the ground, the control circuit 103 causes the contact 4 to be at a relatively high potential via the pull-high circuit 1031, and causes the contact 5 to be at a relatively low potential. Accordingly, the control signal SCTRL of the control circuit 103 is changed, which causes the signal switch 102 to connect the contact 6 with the contact 7, thereby causing the external antenna 1*a* to be connected to the radio frequency circuit 105. Therefore, the external antenna 1*a* can operate or be enabled to receive and send the radio frequency signal.

The switching way of the present invention is performed by the cooperation of the connector 101 with the signal switch 102, rather than merely by the connector 101. The signal switch 102 includes at least a contact 7 (the first signal terminal), the contact 8 (the second signal terminal) and the contact 6 (the third signal terminal). The signal switch 102 can be electrically connected to the control circuit 103 via the contacts 4 and 5 (the control signal terminals). The contact 7 is connected to a signal conductor (not shown) of the connector 101. The contact 8 is connected to the built-in antenna 2*a*. The contact 6 is connected to the radio frequency circuit 105.

The implementation of the connector 101 of the present invention will be described as follows.

Figure 3:
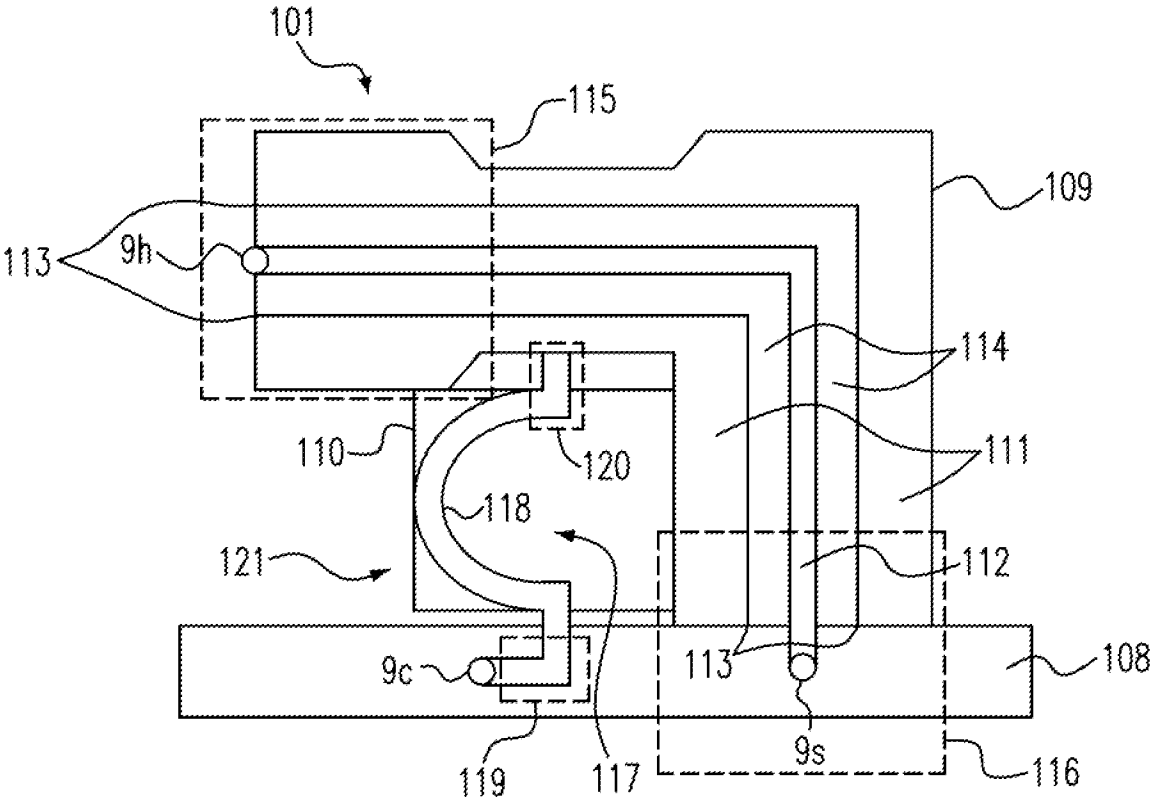
FIG. 3 shows a connector according to an embodiment of the present invention.
Figure 4:
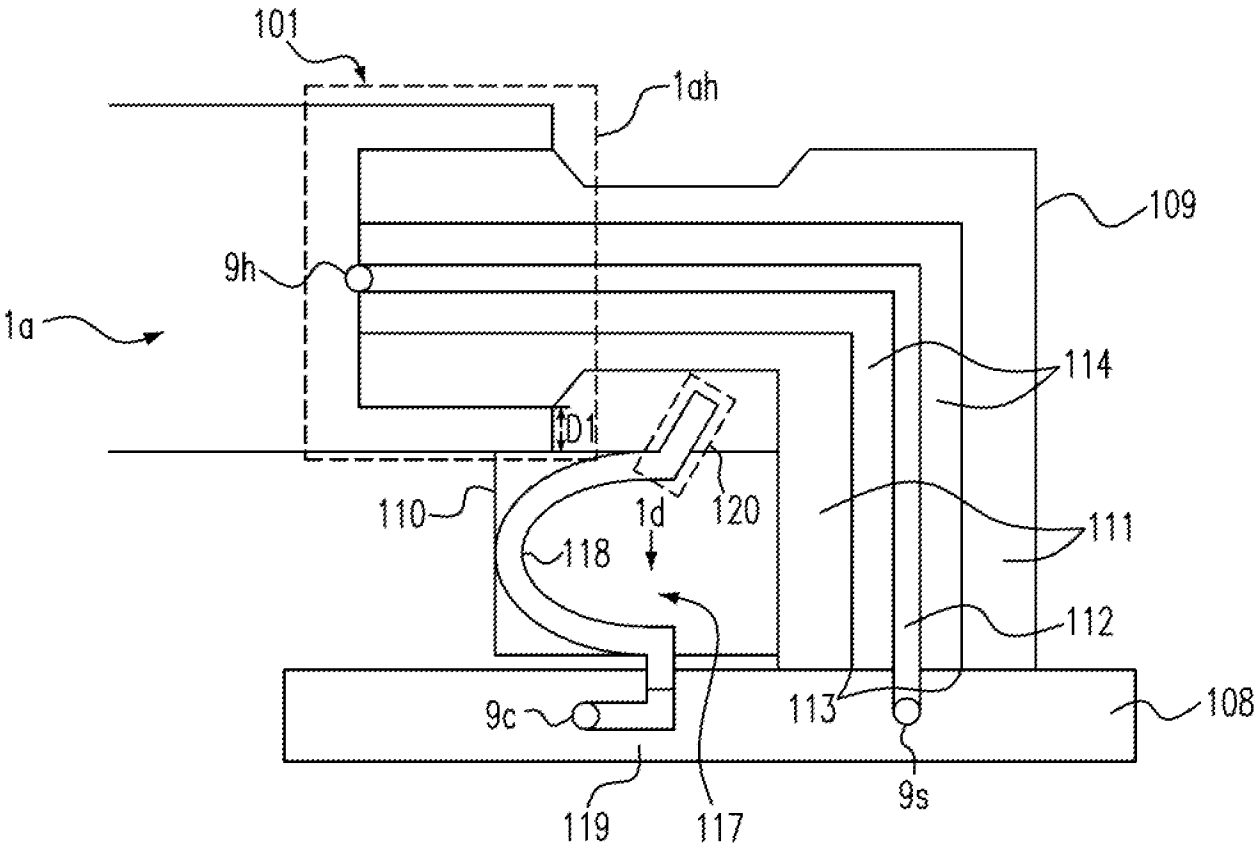
FIG. 4 shows the connection of an external antenna with the connector of FIG. 3 according to an embodiment of the present invention.

Please refer to FIGS. 3 and 4. FIG. 3 shows a connector 101 according to an embodiment of the present invention, and FIG. 4 shows the connection of an external antenna 1*a* with the connector 101 of FIG. 3 according to an embodiment of the present invention. As shown in FIG. 3, the connector 101 can serve as a radio frequency switch connector or a coaxial connector for being connected to the external antenna 1*a*. The connector 101 can be cylindrical and have a bend. The connector 101 includes a first cavity 109, a second cavity 110 and a flexible conductor 117. The first cavity 109 includes a housing conductor 111 and a signal conductor 112. A receiving space 113 is formed at the inner side of the housing conductor 111, and the housing conductor 111 is grounded. The signal conductor 112 has contacts 9*h* and 9*s*. The contact 9*h* can be the contact 1 of FIG. 2 and serves as the signal feeding terminal. The contact 9*s* is connected to the contact 7 of the signal switch 102 so as to be electrically connected to the external antenna 1*a*.

The signal conductor 112 and a first insulator 114 are disposed in the receiving space 113. The first insulator 114 covers the signal conductor 112 and separates the signal conductor 112 from the housing conductor 111. The first cavity 109 has a first joint portion 115 and a second joint portion 116. The first joint portion 115 is coupled to the external antenna 1*a*, and the second joint portion 116 is vertically coupled to a circuit board 108. The first joint portion 115 and the second joint portion 116 form a bending structure along the first cavity 109. The bending structure has a right angle. The second cavity 110 is fixed to a recess 121 of the bending structure.

As shown in FIG. 3, the second cavity 110 is fixed to a side of the first cavity 109, and has an opening for facilitating the coupling of the external antenna 1*a*. The flexible conductor 117 has a connecting end 119, a propping end 120 and an arc structure 118. The surface of the joint 1*ah* of the external antenna 1*a* is made of an insulating material, or the portion of the flexible conductor 117 that contacts the joint 1*ah* is covered with an insulating material, for separating the joint 1*ah* from the flexible conductor 117. The connecting end 119 is electrically connected to the control circuit 103. More specifically, the connecting end 119 has a contact 9*c* for being connected to the contact 3 to generate the control signal SCTRL. The control signal SCTRL can control the control circuit 103. The propping end 120 props the housing conductor 111 and is exposed outside the second cavity 110. The arc structure 118 is disposed in the second cavity 110, and has a specific shape and flexibility. When the signal conductor 112 is connected to the external antenna 1*a*, the specific shape is deformed to cause the propping end 120 to be disconnected from the housing conductor 111, thereby causing the control circuit 103 to enable the external antenna 1*a*.

Please refer to FIG. 4, which shows the connection of an external antenna 1*a* with the connector 101 of FIG. 3 according to an embodiment of the present invention. More specifically, according to an embodiment of the present invention, the outer side of the housing conductor 111 corresponding to the first joint 115 has a threaded portion (not shown). The joint 1*ah* of the external antenna 1*a* has a threaded structure (not shown) for being engaged with the threaded portion. When the threaded structure of the joint 1*ah* of the external antenna 1*a* is engaged with the threaded portion, the arc structure 118 is compressed by the joint 1*ah* due to screwing the joint 1*ah* so that the arc structure 118 generates deformation toward a first direction 1*d* to form a pitch D1, thereby causing the propping end 120 to be disconnected from the housing conductor 111.

When the connector 101 is not coupled to the external antenna 1*a*, the propping end 120 contacts the housing conductor 111, and the housing conductor 111 is grounded, i.e. equal to a zero potential, and is also connected to the ground of the circuit board 108. When the connector 101 is coupled to the external antenna 1*a* to cause the propping end 120 to be disconnected from the housing conductor 111, due to the influence of the pull-high circuit 1031, the contacts 9*c*, 3 and 4 of FIG. 2 cause the control signal SCTRL to be enhanced from a low potential to a high potential. This controls the signal switch 102 to switch the conducting path between the contact 6 and the contact 8 to the conducting path between the contact 6 and the contact 7.

In this way, the antenna for the radio frequency circuit 105 can be switched from the built-in antenna 2*a* to the external antenna 1*a*. When the external antenna 1*a* is removed, the arc structure 118 returns to the original shape to cause the propping end 120 to contact the housing conductor 111 again. This causes the control signal SCTRL of FIG. 2 to be converted from a high potential to a low potential, thereby controlling the signal switch 102 to switch the conducting path between the contact 6 and the contact 7 to the conducting path between the contact 6 and the contact 8. In this way, the antenna for the radio frequency circuit 105 can be switched from the external antenna 1*a* to the built-in antenna 2*a*.

The following Table 1 illustrates the statuses of the contacts 1-5 when the radio frequency circuit 105 is coupled to the built-in antenna 2*a*.

TABLE 1

| | Contact | | | | |
|---|---|---|---|---|---|
| | 1 | 2 | 3 | 4 | 5 |
| Status | Not coupled to the external antenna | Low potential | Low potential | Low potential | High potential |

Please refer to FIG. 1 and Table 1 simultaneously. The respective signals of the contact 4 and the contact 5 control the switching of the signal switch 102. When the status of the contact 4 is the low potential and the status of the contact 5 is the high potential, the contact 6 of the signal switch 102 is electrically connected to the contact 8 thereof. In another embodiment, when the status of the contact 4 is the high potential and the status of the contact 5 is the low potential, the contact 6 of the signal switch 102 is electrically connected to the contact 8 thereof. In a further embodiment, the switching of the signal switch 102 can be controlled by only determining whether the status of the contact 4 is the high potential or the low potential, which can be decided according to the design demand.

The following Table 2 illustrates the statuses of the contacts 1-5 when the radio frequency circuit 105 is coupled to the external antenna 1*a*.

TABLE 2

| | Contact | | | | |
|---|---|---|---|---|---|
| | 1 | 2 | 3 | 4 | 5 |
| Status | Coupled to the external antenna | Low potential | Floating | High potential | Low potential |

Please refer to FIG. 2 and Table 2 simultaneously. When the propping end 120 is disconnected from the housing conductor 111, due to floating, the potential of the contact 3 is enhanced to a high potential by the pull-high circuit 1031. At this time, the status of the contact 4 is the high potential and the status of the contact 5 is the low potential, and the contact 6 of the signal switch 102 is electrically connected to the contact 7 thereof. In another embodiment, when the status of the contact 4 is the low potential and the status of the contact 5 is the high potential, the contact 6 of the signal switch 102 is electrically connected to the contact 7 thereof. In a further embodiment, the switching of the signal switch 102 can be controlled by only determining whether the status of the contact 4 is the high potential or the low potential, which can be decided according to the design demand.

In another embodiment of FIG. 2, the conduction between the contact 2 of the connector 101 and the contact 3 thereof also can cause the antenna for the radio frequency circuit 105 to be switched from the built-in antenna 2*a* to the external antenna 1*a*, which is decided according to the design demand. For example, the structure of the connector 101 can be designed as a normally open structure. That is, when the external antenna 1*a* is not coupled to the connector 101, the contact 2 is disconnected from the contact 3; when the external antenna 1*a* is coupled to the connector 101, the contact 2 is connected to the contact 3, thereby causing the antenna for the radio frequency circuit 105 to be switched from the built-in antenna 2*a* to the external antenna 1*a*. In a further embodiment, the structure of the connector 101 also can be designed as a normally close structure, e.g. the structure of the connector 101 of the present invention. When the external antenna 1*a* is coupled to the connector 101, the contact 2 is disconnected from the contact 3, thereby causing the antenna for the radio frequency circuit 105 to be switched from the built-in antenna 2*a* to the external antenna 1*a*.

In another embodiment of FIGS. 3 and 4, the second cavity 110 can be unnecessary. The first cavity 109 and the flexible conductor 117 are two separate components. The steps of assembly include coupling the first cavity 109 to the circuit board 108, e.g. soldering the first cavity 109 to the circuit board 108; soldering the connecting end 119 of the flexible conductor 117 to a suitable position of the circuit board 108; and performing suitable deformation for the arc structure 118 of the flexible conductor 117 to cause the propping end 120 of the flexible conductor 117 to contact the housing conductor 111. In this embodiment, the flexible conductor 117 can be fixed to the circuit board 108 for assembly. When the second cavity 110 is configured to fix the flexible conductor 117 to a side of the first cavity 109, the first cavity 109 and the second cavity 110 can serve as a module to be configured on the circuit board 108. In this embodiment, the arc structure 118 of the flexible conductor 117 can be covered with a layer of insulator (not shown) to separate the joint 1*ah* from the arc structure 118. This can prevent the arc structure 118 from being grounded directly to cause a failure of the mechanical switching function of the connector 101, when the joint 1*ah* is screwed. The joint 1*ah* has an inner surface and an outer surface (not shown). According to an embodiment of the present invention, the inner surface and the outer surface can be formed by a conductive material. According to another embodiment of the present invention, the inner surface is formed by a conductive material, and the outer surface is formed by an insulating material. In practice, the joint 1*ah* does not contact the propping end 120 when it is screwed so as not to damage the mechanical switching function of the connector 101.

Figure 5:
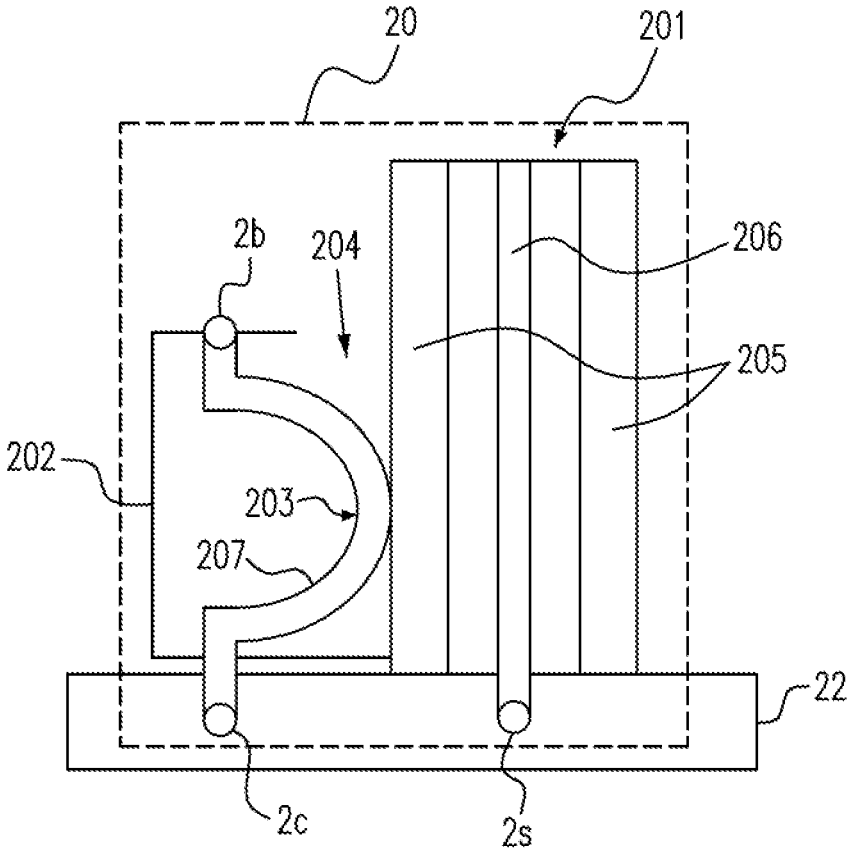
FIG. 5 shows a connector according to another embodiment of the present invention.

Please refer to FIG. 5, which shows a connector 20 according to another embodiment of the present invention. The connector 20 includes a first cavity 201, a second cavity 202 and a flexible conductor 203. The first cavity 201 can be cylindrical and unbent. The second cavity 202 is fixed to a side of the first cavity 201, and has an opening 204 for facilitating the coupling of the external antenna 1*a*. The first cavity 201 includes a housing conductor 205 and a signal conductor 206. The housing conductor 205 is grounded, and is vertically fixed to the circuit board 22. The signal conductor 206 is electrically connected to the contact 7 via the contact 2*s*. The flexible conductor 203 includes the contact 2*c*, the contact 2*b* and the arc structure 207. The arc structure 207 can be fixed by the contact 2*c* and the contact 2*b*. The contact 2*c* is connected to the contact 3 for controlling the control circuit 103.

The arc structure 207 has flexibility. When the connector 20 is not coupled to the external antenna 1*a*, the arc structure 207 contacts the housing conductor 205. When the connector 20 is coupled to the external antenna 1*a*, the arc structure 207 is disconnected from the housing conductor 205 to enable the external antenna 1*a*.

Figure 6:
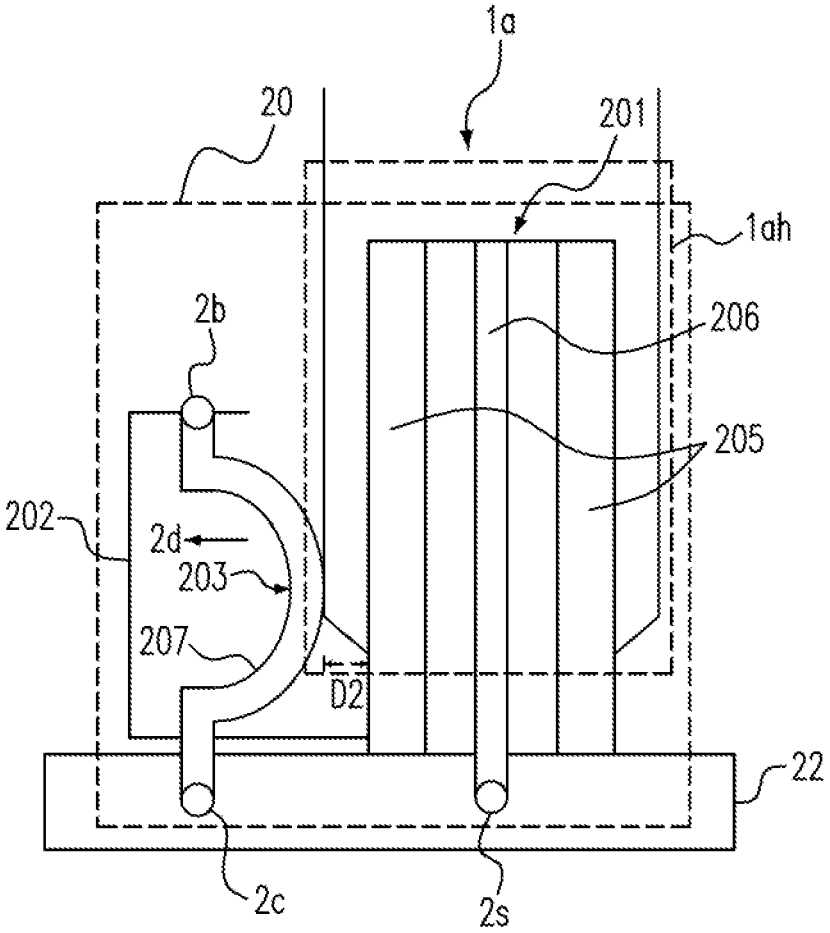
FIG. 6 shows the connection of an external antenna with the connector of FIG. 5 according to another embodiment of the present invention.

Please refer to FIG. 6, which shows the connection of an external antenna 1*a* with the connector 20 of FIG. 5 according to another embodiment of the present invention. When the connector 20 is coupled to the external antenna 1*a*, the arc structure 207 of the flexible conductor 203 is compressed by the joint 1*ah* so that the arc structure 207 generates deformation toward a second direction 2*d* to form a pitch D2, thereby causing the arc structure 207 to be disconnected from the housing conductor 205. Similarly, due to floating, the respective potentials of the contacts 2*c*, 3 and 4 are enhanced to high potentials by the pull-high circuit 1031, thereby causing the signal switch 103 to select the conducting path for enabling the external antenna 1*a*. In an embodiment, the joint 1*ah* of the external antenna 1*a* has an outer surface and an inner surface (not shown). The outer surface is made of an insulating material, or the portion of the flexible conductor 203 that contacts the outer surface is covered with an insulating material, for separating the flexible conductor 203 from the housing conductor 205 to prevent a failure of the mechanical switching function of the connector 20. The inner surface of the joint 1*ah* contacts the housing conductor 205 to cause the external antenna 1*a* and the housing conductor 205 to be connected to the ground together.

Similarly, when the external antenna 1*a* is removed from the connector 20, the shape of the flexible conductor 203 is restored so that the arc structure 207 contacts the housing conductor 205 once again. This causes the respective potentials of the contacts 2*c*, 2 and 4 to be converted to low potentials once again, thereby causing the signal switch 102 to be switched to the built-in antenna 2*a*.

Figure 7:
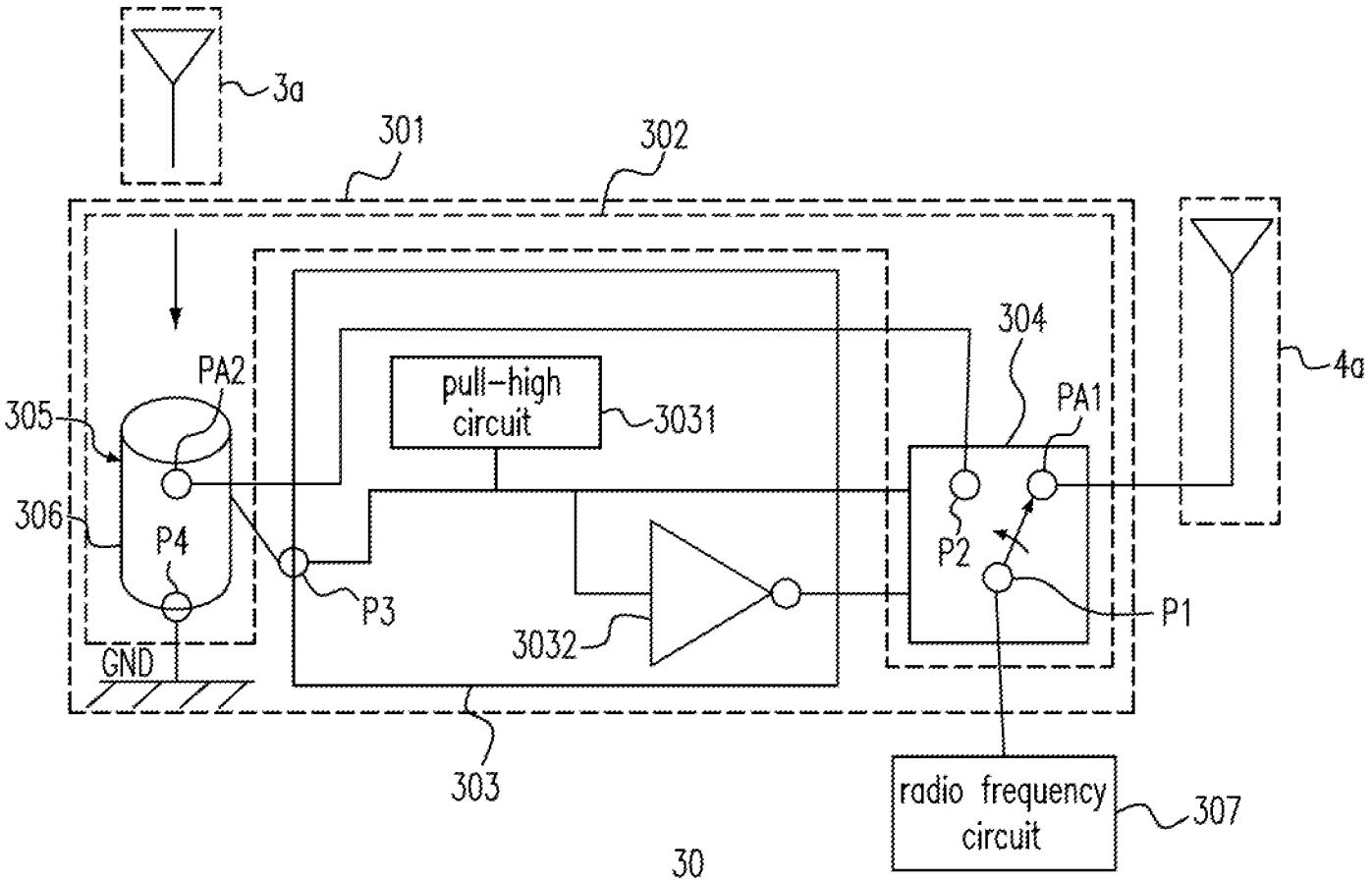
FIG. 7 shows a switch module for the WTRU according to an embodiment of the present invention.

Please refer to FIG. 7, which shows a switch module 301 for the WTRU 30 according to an embodiment of the present invention. The WTRU 30 has a radio frequency circuit 307, a built-in antenna 4*a* and a ground terminal GND. The switch module 301 includes a switch device 302 and a control circuit 303. The switch device 302 includes a first antenna terminal PA1, a second antenna terminal PA2, a first terminal P1, a second terminal P2, a third terminal P3 and a fourth terminal P4. The first antenna terminal PA1 is configured to connect the built-in antenna 4*a*. The first terminal P1 is connected to the radio frequency circuit 307. The second antenna terminal PA2 is configured to connect an external antenna 3*a*. The fourth terminal P4 is connected to the ground terminal GND.

As shown in FIG. 7, the control circuit 303 is electrically connected to the switch device 302. When the third terminal P3 is connected to the fourth terminal P4, the control circuit 303 causes the first terminal P1 to be connected to one of the first antenna terminal PA1 and the second terminal P2. When the third terminal P3 is disconnected from the fourth terminal P4, the control circuit 303 causes the first terminal P1 to be connected to the other of the first antenna terminal PA1 and the second terminal P2.

As shown in FIG. 7, the second antenna terminal PA2 is coupled to the second terminal P2 via the control circuit 303. The switch device 302 includes a signal switch 304 and a connector 305. The connector 305 includes a housing conductor 306. The signal switch 304 has the first antenna terminal PA1, the first terminal P1 and the second terminal P2. The connector 305 has the second antenna terminal PA2 and the fourth terminal P4. The control circuit 303 further includes a pull-high circuit 3031 and an inverter 3032. The pull-high circuit 3031 is electrically connected to the signal switch 304. The inverter 3032 is electrically connected between the pull-high circuit 3031 and the signal switch 304.

When the external antenna 3*a* is connected to the connector 305, the external antenna 3*a* is connected to the second antenna terminal PA2, the housing conductor 306 is disconnected from the third terminal P3, and the output potential of the control circuit 303 is changed by the pull-high circuit 3031 to control the switching of the signal switch 304, thereby causing the external antenna 3*a* to be electrically connected to the radio frequency circuit 307. When the external antenna 3*a* is not connected to the connector 305, the external antenna 3*a* is disconnected from the second antenna terminal PA2, and the housing conductor 306 is connected to the third terminal P3 so that the potential of the control circuit 303 is changed to control the switching of the signal switch 304, thereby causing the built-in antenna 4*a* to be electrically connected to the radio frequency circuit 307.

Figure 8:
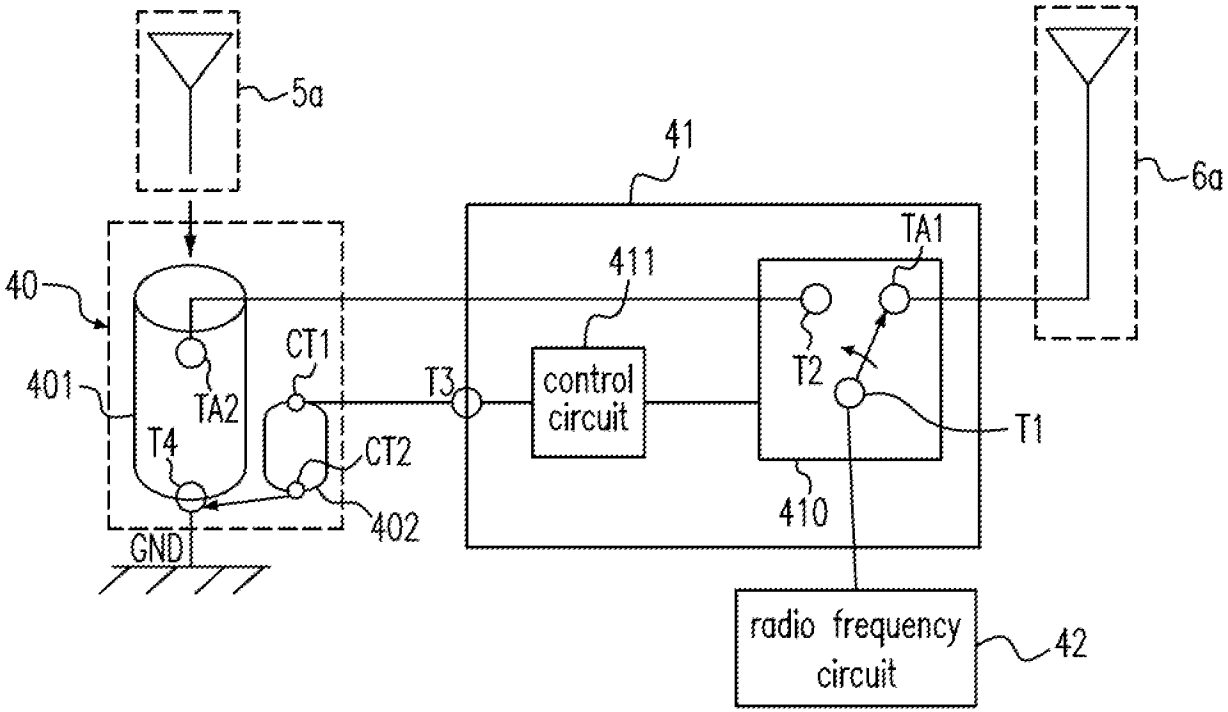
FIG. 8 shows a connector for a switch module according to an embodiment of the present invention.

Please refer to FIG. 8, which shows a connector 40 for a switch module 41 according to an embodiment of the present invention. The switch module 41 has a first antenna terminal TA1, a first terminal T1, a second terminal T2 and a third terminal T3. The connector 40 includes a connector body 401, a second antenna terminal TA2, a fourth terminal T4 and a flexible conductor 402. The second antenna terminal TA2 and the fourth terminal T4 are both disposed in the connector body 401. The flexible conductor 402 has a first conductor terminal CT1 and a second conductor terminal CT2. The first conductor terminal CT1 is electrically connected to the third terminal T3. When the second conductor terminal CT2 is connected to the fourth terminal T4, the switch module 41 causes the first terminal T1 to be connected to one of the first antenna terminal TA1 and the second terminal T2. When the second conductor terminal CT2 is disconnected from the fourth terminal T4, the switch module 41 causes the first terminal T1 to be connected to the other of the first antenna terminal TA1 and the second terminal T2.

As shown in FIG. 8, the switch module 41 is connected to the second antenna terminal TA2 of the connector 40 via the second terminal T2, and connected to a radio frequency circuit 42 via the first terminal T1. The connector 40 is connected to an external antenna 5*a* via the second antenna terminal TA2. When the external antenna 5*a* is connected to the connector 40, the second conductor terminal CT2 of the connector 40 is disconnected from the fourth terminal T4 so that the switch module 41 is switched, thereby causing the first terminal T1 to be electrically connected to the second terminal T2. When the external antenna 5*a* is not connected to the connector 40, the second conductor terminal CT2 of the connector 40 is connected to the fourth terminal T4 so that the switch module 41 is switched, thereby causing the first terminal T1 to be electrically connected to the first antenna terminal TA1.

As shown in FIG. 8, the switch module 41 includes a switch device 410 and a control circuit 411. The switch device 410 has the first antenna terminal TA1, the first terminal T1 and the second terminal T2. The fourth terminal T4 is connected to the ground terminal GND. The control circuit 411 is electrically connected to the switch device 410. When the second conductor terminal CT2 is connected to the fourth terminal T4, the control circuit 411 causes the first terminal T1 to be connected to one of the first antenna terminal TA1 and the second terminal T2. When the second conductor terminal CT2 is disconnected from the fourth terminal T4, the control circuit 411 causes the first terminal T1 to be connected to the other of the first antenna terminal TA1 and the second terminal T2.

Embodiments

1. A connector for a switch module, comprising:

a first cavity, including:

a housing conductor having a receiving space formed at an inner side thereof, and connected to a ground; and a signal conductor disposed in the receiving space; and a second cavity fixed to a side of the first cavity; and a flexible conductor having a connecting end, a propping end and an arc structure, wherein the connecting end is electrically connected to a control circuit, the propping end props the housing conductor, the arc structure is disposed in the second cavity and has a specific shape and a flexibility, and when the signal conductor is connected to a joint of a first antenna, the specific shape is deformed to cause the propping end to be disconnected from the housing conductor, thereby causing the control circuit to enable the first antenna.

2. The connector of Embodiment 1, wherein:

the first cavity further includes a first insulator disposed in the receiving space and separating the signal conductor from the housing conductor; and the second cavity further includes a second insulator covering a portion of the flexible conductor that contacts the joint of the first antenna and separating the flexible conductor from the housing conductor.

3. The connector of any one of Embodiments 1-2, wherein:

the first insulator covers the signal conductor; and the second insulator covers the arc structure.

4. The connector of any one of Embodiments 1-3, wherein:

the first cavity has a first joint portion and a second joint portion, the first joint portion is coupled to the first antenna, and the second joint portion is vertically coupled to a circuit board; and the first joint portion and the second joint portion form a bending structure along the first cavity, the bending structure has a right angle, and the second cavity is fixed to a recess of the bending structure.

5. The connector of any one of Embodiments 1-4, wherein:

the control circuit controls a switching of a signal switch;

when the signal conductor is not connected to the first antenna, the signal switch conducts a second antenna and a radio frequency circuit;

when the signal conductor is connected to the first antenna, the signal switch conducts the first antenna and the radio frequency circuit;

the first antenna is an external antenna; and the second antenna is a built-in antenna.

6. The connector of any one of Embodiments 1-5, wherein the first cavity is cylindrical and unbent.

7. The connector of any one of Embodiments 1-6, wherein:

the first antenna has a signal feeding terminal;

the signal conductor has a first terminal and a second terminal;

the first terminal is connected to the signal feeding terminal; and the second terminal is connected to a signal switch.

8. The connector of any one of Embodiments 1-7, wherein:

the housing conductor has an outer side corresponding to a first joint portion of the connector and having a threaded portion;

the joint of the first antenna has a threaded structure for being engaged with the threaded portion; and when the threaded structure is engaged with the threaded portion, the arc structure is compressed by the joint of the first antenna due to screwing the joint of the first antenna so that the arc structure generates a deformation toward a first direction to form a pitch, thereby causing the propping end to be disconnected from the housing conductor.

9. The connector of any one of Embodiments 1-8, wherein:

the control circuit is connected to a signal switch, and the signal switch is connected to the connector, a second antenna and a radio frequency circuit; and the control circuit further includes a pull-high circuit and an inverter, the pull-high circuit is electrically connected to the signal switch, and the inverter is connected between the pull-high circuit and the signal switch.

10. The connector of any one of Embodiments 1-9, wherein:

when the first antenna is connected to the connector via the signal conductor, the housing conductor is disconnected from the control circuit, and a potential of the control circuit is changed by the pull-high circuit to control a switching of the signal switch, thereby causing the first antenna to be electrically connected to the radio frequency circuit; and when the first antenna is not connected to the connector, the housing conductor is connected to the control circuit so that the potential of the control circuit is changed to control the switching of the signal switch, thereby causing the second antenna to be electrically connected to the radio frequency circuit.

11. The connector of any one of Embodiments 1-10, wherein:

the control circuit is connected to a signal switch, and the signal switch is connected to the connector, a second antenna and a radio frequency circuit.

12. The connector of any one of Embodiments 1-11, wherein:

the signal switch includes at least a control signal terminal, a first signal terminal, a second signal terminal and a third signal terminal;

the control signal terminal is connected to the control circuit;

the first signal terminal is connected to the signal conductor of the connector;

the second signal terminal is connected to the second antenna; and the third signal terminal is connected to the radio frequency circuit.

13. The connector of any one of Embodiments 1-12, wherein:

when the first antenna is connected to the connector via the signal conductor, the housing conductor of the connector is disconnected from the control circuit so that a potential of the control circuit is changed to control a switching of the signal switch, thereby causing the first signal terminal to be electrically connected to the third signal terminal; and when the first antenna is not connected to the connector, the housing conductor of the connector is electrically connected to the control circuit so that the potential of the control circuit is changed to control the switching of the signal switch, thereby causing the second signal terminal to be electrically connected to the third signal terminal.

14. A switch module for a wireless transmit receive unit (WTRU) having a radio frequency circuit, a built-in antenna and a ground terminal, comprising:

a switch device having a first antenna terminal, a second antenna terminal, a first terminal, a second terminal, a third terminal and a fourth terminal, wherein the first antenna terminal is configured to connect the built-in antenna, the first terminal is connected to the radio frequency circuit, the second antenna terminal is configured to connect an external antenna, and the fourth terminal is connected to the ground terminal; and a control circuit electrically connected to the switch device, causing the first terminal to be connected to one of the first antenna terminal and the second terminal when the third terminal is connected to the fourth terminal, and causing the first terminal to be connected to the other of the first antenna terminal and the second terminal when the third terminal is disconnected from the fourth terminal.

15. The switch module of Embodiment 14, wherein:

the second antenna terminal is coupled to the second terminal via the control circuit;

the switch device includes a signal switch and a connector, and the connector includes a housing conductor;

the signal switch has the first antenna terminal, the first terminal and the second terminal;

the connector has the second antenna terminal and the fourth terminal; and the control circuit further includes a pull-high circuit and an inverter, the pull-high circuit is electrically connected to the signal switch, and the inverter is connected between the pull-high circuit and the signal switch.

16. The switch module of any one of Embodiments 14-15, wherein:

when the external antenna is connected to the connector, the external antenna is connected to the second antenna terminal, the housing conductor is disconnected from the third terminal, and a potential of the control circuit is changed by the pull-high circuit to control a switching of the signal switch, thereby causing the external antenna to be electrically connected to the radio frequency circuit; and when the external antenna is not connected to the connector, the external antenna is disconnected from the second antenna terminal, and the housing conductor is connected to the third terminal so that the potential of the control circuit is changed to control the switching of the signal switch, thereby causing the built-in antenna to be electrically connected to the radio frequency circuit.

17. A connector for a switch module having a first antenna terminal, a first terminal, a second terminal and a third terminal, comprising:

a connector body;

a second antenna terminal disposed in the connector body;

a fourth terminal disposed in the connector body; and a flexible conductor having a first conductor terminal electrically connected to the third terminal, and a second conductor terminal, wherein when the second conductor terminal is connected to the fourth terminal, the switch module causes the first terminal to be connected to one of the first antenna terminal and the second terminal, and when the second conductor terminal is disconnected from the fourth terminal, the switch module causes the first terminal to be connected to the other of the first antenna terminal and the second terminal.

18. The connector of Embodiment 17, wherein:

the switch module is connected to the second antenna terminal of the connector via the second terminal;

the switch module is connected to a radio frequency circuit via the first terminal; and the connector is connected to an external antenna via the second antenna terminal.

19. The connector of any one of Embodiments 17-18, wherein:

when the external antenna is connected to the connector, the second conductor terminal of the connector is disconnected from the fourth terminal so that the switch module is switched, thereby causing the first terminal to be electrically connected to the second terminal; and when the external antenna is not connected to the connector, the second conductor terminal of the connector is connected to the fourth terminal so that the switch module is switched, thereby causing the first terminal to be electrically connected to the first antenna terminal.

20. The connector of any one of Embodiments 17-19, wherein the switch module comprises:

a switch device having the first antenna terminal, the first terminal and the second terminal, wherein the fourth terminal is connected to a ground terminal; and a control circuit electrically connected to the switch device, causing the first terminal to be connected to one of the first antenna terminal and the second terminal when the second conductor terminal is connected to the fourth terminal, and causing the first terminal to be connected to the other of the first antenna terminal and the second terminal when the second conductor terminal is disconnected from the fourth terminal.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A connector for a switch module, comprising:

a first cavity, including:

a housing conductor having a receiving space formed at an inner side thereof, and connected to a ground; and a signal conductor disposed in the receiving space;

a second cavity fixed to a side of the first cavity; and a flexible conductor having a connecting end, a propping end and an arc structure, wherein the connecting end is electrically connected to a control circuit, the propping end props the housing conductor, the arc structure is disposed in the second cavity and has a specific shape and a flexibility, and when the signal conductor is connected to a joint of a first antenna, the specific shape is deformed to cause the propping end to be disconnected from the housing conductor, thereby causing the control circuit to enable the first antenna.

2. A connector as claimed in claim 1, wherein:

the first cavity further includes a first insulator disposed in the receiving space and separating the signal conductor from the housing conductor; and the second cavity further includes a second insulator covering a portion of the flexible conductor that contacts the joint of the first antenna and separating the flexible conductor from the housing conductor.

3. A connector as claimed in claim 2, wherein:

the first insulator covers the signal conductor; and the second insulator covers the arc structure.

4. A connector as claimed in claim 3, wherein:

the first cavity has a first joint portion and a second joint portion, the first joint portion is coupled to the first antenna, and the second joint portion is vertically coupled to a circuit board; and the first joint portion and the second joint portion form a bending structure along the first cavity, the bending structure has a right angle, and the second cavity is fixed to a recess of the bending structure.

5. A connector as claimed in claim 4, wherein:

the control circuit controls a switching of a signal switch;

when the signal conductor is not connected to the first antenna, the signal switch conducts a second antenna and a radio frequency circuit;

when the signal conductor is connected to the first antenna, the signal switch conducts the first antenna and the radio frequency circuit;

the first antenna is an external antenna; and the second antenna is a built-in antenna.

6. A connector as claimed in claim 1, wherein the first cavity is cylindrical and unbent.

7. A connector as claimed in claim 6, wherein:

the first antenna has a signal feeding terminal;

the signal conductor has a first terminal and a second terminal;

the first terminal is connected to the signal feeding terminal; and the second terminal is connected to a signal switch.

8. A connector as claimed in claim 7, wherein:

the housing conductor has an outer side corresponding to a first joint portion of the connector and having a threaded portion;

the joint of the first antenna has a threaded structure for being engaged with the threaded portion; and when the threaded structure is engaged with the threaded portion, the arc structure is compressed by the joint of the first antenna due to screwing the joint of the first antenna so that the arc structure generates a deformation toward a first direction to form a pitch, thereby causing the propping end to be disconnected from the housing conductor.

9. A connector as claimed in claim 1, wherein:

the control circuit is connected to a signal switch, and the signal switch is connected to the connector, a second antenna and a radio frequency circuit; and the control circuit further includes a pull-high circuit and an inverter, the pull-high circuit is electrically connected to the signal switch, and the inverter is connected between the pull-high circuit and the signal switch.

10. A connector as claimed in claim 9, wherein:

when the first antenna is connected to the connector via the signal conductor, the housing conductor is disconnected from the control circuit, and a potential of the control circuit is changed by the pull-high circuit to control a switching of the signal switch, thereby causing the first antenna to be electrically connected to the radio frequency circuit; and when the first antenna is not connected to the connector, the housing conductor is connected to the control circuit so that the potential of the control circuit is changed to control the switching of the signal switch, thereby causing the second antenna to be electrically connected to the radio frequency circuit.

11. A connector as claimed in claim 1, wherein:

the control circuit is connected to a signal switch, and the signal switch is connected to the connector, a second antenna and a radio frequency circuit.

12. A connector as claimed in claim 11, wherein:

the signal switch includes at least a control signal terminal, a first signal terminal, a second signal terminal and a third signal terminal;

the control signal terminal is connected to the control circuit;

the first signal terminal is connected to the signal conductor of the connector;

the second signal terminal is connected to the second antenna; and the third signal terminal is connected to the radio frequency circuit.

13. A connector as claimed in claim 12, wherein:

when the first antenna is connected to the connector via the signal conductor, the housing conductor of the connector is disconnected from the control circuit so that a potential of the control circuit is changed to control a switching of the signal switch, thereby causing the first signal terminal to be electrically connected to the third signal terminal; and when the first antenna is not connected to the connector, the housing conductor of the connector is electrically connected to the control circuit so that the potential of the control circuit is changed to control the switching of the signal switch, thereby causing the second signal terminal to be electrically connected to the third signal terminal.

* * * * *